US005339989A

United States Patent [19]

Coleman

[11] Patent Number: 5,339,989

[45] Date of Patent: * Aug. 23, 1994

[54] BULK MATERIAL CONTAINING HAVING A FLEXIBLE LINER WITH A FOLLOWER

[75] Inventor: Clarance B. Coleman, Oakland, Calif.

[73] Assignee: Fabricated Metals, Inc., San Leandro, Calif.

[ * ] Notice: The portion of the term of this patent subsequent to Dec. 31, 2008 has been disclaimed.

[21] Appl. No.: 763,627

[22] Filed: Sep. 23, 1991

Related U.S. Application Data

[63] Continuation of Ser. No. 519,784, May 7, 1990, Pat. No. 5,076,471.

[51] Int. Cl.[5] ..... B65D 35/56

[52] U.S. Cl. ..... 222/105; 222/95

[58] Field of Search ..... 226/92, 95, 105, 386.5

[56] References Cited

U.S. PATENT DOCUMENTS

| | | | |
|---|---|---|---|
| 2,074,959 | 3/1937 | Guest | 73/82 |
| 2,798,639 | 7/1957 | Urban | 220/85 |
| 2,836,963 | 6/1958 | Fox | 62/1 |
| 3,468,451 | 9/1969 | Coleman | 220/63 |
| 3,494,509 | 2/1970 | McGuire | 222/107 |
| 3,590,888 | 7/1971 | Coleman | 141/5 |
| 3,734,348 | 5/1973 | White | 222/1 |
| 3,880,326 | 4/1975 | Kennard | 222/95 |
| 3,917,124 | 11/1975 | Kifer | 222/386 |
| 4,280,637 | 7/1981 | Runciman | 222/39 |
| 4,471,892 | 9/1984 | Coleman | 222/386.5 |
| 4,516,692 | 5/1985 | Croley | 222/105 |
| 4,532,800 | 8/1985 | Coleman | 73/308 |
| 4,552,090 | 11/1985 | Coleman | 116/204 |
| 4,886,189 | 12/1989 | Vanderjagt | 222/49 |
| 4,893,731 | 1/1990 | Richter | 222/92 |
| 4,960,227 | 10/1990 | Coleman | 222/94 |
| 5,069,359 | 12/1991 | Liebel | 222/105 X |

FOREIGN PATENT DOCUMENTS

| | | | |
|---|---|---|---|
| 0206195 | 12/1986 | European Pat. Off. . | |
| 2355410 | 11/1973 | Fed. Rep. of Germany | 81/133 |
| 2731448 | 1/1978 | Fed. Rep. of Germany . | |
| 2388733 | 4/1977 | France . | |
| 8706922 | 11/1987 | World Int. Prop. O. | 222/386.5 |

*Primary Examiner*—Andres Kashnikow
*Assistant Examiner*—Joseph A. Kaufman
*Attorney, Agent, or Firm*—Jack M. Wiseman

[57] ABSTRACT

A bulk material container in which is disposed a flexible liner for storing bulk material. A rigid follower is attached at the top wall of the flexible liner for moving the top wall of the flexible liner to the level of the bulk material in the flexible liner during the removal of bulk material from the flexible liner. A rigid base is attached at the bottom wall of the flexible liner to facilitate the installation of the flexible liner into the bulk material container. The bulk material container and flexible liner provide an arrangement for storing, transporting and dispensing bulk material without contact between the bulk material and the container.

12 Claims, 6 Drawing Sheets

BULK MATERIAL CONTAINING HAVING A FLEXIBLE LINER WITH A FOLLOWER

RELATED CASE

This application is a continuation of my pending application, Ser. No. 07/519,784, filed on May 7, 1990, now U.S. Pat. No. 5,076,471, for Bulk Material Container Having A Flexible Liner With A Follower.

BACKGROUND OF THE INVENTION

The present invention relates in general to bulk material containers, and more particularly to a bulk material container having a flexible liner for containing bulk material.

Heretofore, bulk material containers were filled with bulk material, such as grease, and were shipped to users. The user removed the grease from the bulk material container using a wiping type follower and a pump or the like. As a consequence thereof, a film of grease remained on the inner wall of the shell of the container, on the underside of the follower and on the bottom wall of the container. This resulted in a loss of usable material and also resulted in the contamination of the inner wall of the shell, the underside of the follower and the bottom wall of the container with hazardous material.

In the U.S. Pat. No. 3,468,451, to Coleman issued on Sept. 23, 1969, for Container With Disposable Liner, there is disclosed a flexible tubular liner disposed within a container for storing and transporting fluid material. One end of the liner projects through an opening at the top of the container.

The U.S. Pat. No. 3,590,888, to Coleman issued on Jul. 6, 1971, for Composite Container And Method of Handling Fluent Materials, discloses a flexible bag disposed in a container. Fluent material is admitted into the bag. The material in the bag is discharged through a nozzle by forcing gas into the space between the wall of the container and the bag.

The U.S. Pat. No. 4,471,892, to Coleman issued on Sept. 18, 1984, for Material Container Having A Flexible Follower, discloses a bulk material container having a follower disposed on the upper surface of the bulk material contained by the bulk material container. During the removal of bulk material from the container, the follower moves downwardly in continuous engagement with the upper surface of the bulk material for applying a uniform downward force on the bulk material.

The U.S. Pat. No. 4,532,800, to Coleman issued on Aug. 6, 1985, for a Level Indicator For Liquid Container With A Follower, discloses a bulk material container. Disposed within the container is a follower. The height of the follower within the container varies with the level of the flowable bulk material stored in the container.

In U.S. Pat. No. 4,552,090, to Coleman issued on Nov. 12, 1985, for Bulk Material Container With A Rigid Follower, there is disclosed a floatable rigid follower disposed within the container. The height of the follower within the container varies with the level of flowable material stored in the container.

In U.S. Pat. No. 4,960,227, to Coleman issued on Oct. 2, 1990, for A Bulk Material Container With A Flexible Liner, there is disclosed a flexible liner with a bottom outlet opening disposed within a container.

The U.S. Pat. No. 2,074,959, to Guest issued on Mar. 23, 1937, for Fuel Tank Gauge, discloses a follower disposed in a receptacle. Bellows are attached at the lower end thereof to the follower. The follower plate is held down under pressure against the fuel so that the fuel will be accurately measured at all times.

In U.S. Pat. No. 4,280,637, to Runciman issued on Jul. 28, 1981, for Constant Feed Device, there is disclosed an apparatus in which a pressure applying piston applies pressure to a flexible bag containing a a parenteral fluid.

In U.S. Pat. No. 3,494,509, to McGuire issued on Jun. 13, 1966, for Variable Volume Reservoir there is disclosed a variable volume tank for storing and dispensing jellied fuel. The variable volume tank has an upper panel and a lower panel disposed in contacting relation with pressure plates. The pressure plates effect a pressure in the fuel contained within the tank. The panels are operatively connected to flexible side walls for compression of the fluid within the tank.

In the pending U.S. application, Ser. No. 07/235,979 now U.S. Pat. No. 5,060,826filed on Aug. 25, 1988, for Container With Inflatable Vessel For Controlling Flow Of Liquid O Viscous Material, there is disclosed a bulk material container. In the bulk material container is disposed an inflatable vessel. Also disposed in the container above the inflatable vessel is a compressible vessel containing a product to be disposed. Between the inflatable vessel and the compressible vessel is disposed a generally rigid disc. The assignee of said U.S. application Ser. No. 07/235,979, now U.S. Pat. No. 5,060,826 is the assignee of the present application.

SUMMARY OF THE INVENTION

A bulk material container comprises a flexible liner disposed in a suitable shell. The flexible liner stores bulk material to be dispensed from the container. A rigid follower is contiguous to the flexible liner at the dispensing wall thereof. During the removal of bulk material from the flexible liner, the rigid follower moves urging the dispensing wall of the flexible liner to move therewith to the level of the bulk material stored in the flexible liner and to apply a uniform force to the bulk material during the removal thereof.

A flexible liner for a bulk material container comprising a dispensing wall, a collapsible wall for containing bulk material stored in the flexible liner, a wall opposite to the dispensing wall, and a rigid follower attached at the dispensing wall thereof. During the removal of bulk material from the flexible liner, the rigid follower under the urgency of a differential pressure and/or gravity moves urging the dispensing wall to move therewith to the level of the bulk material stored in the flexible liner and to apply a uniform force to the bulk material during the removal thereof.

A modified bulk material container comprises a flexible liner disposed in a suitable shell. The flexible liner stores material to be dispensed from the container. A rigid follower is contiguous to a wall of the flexible liner opposite from the wall of the flexible liner through which material is dispensed. During the removal of bulk material from the flexible liner, the rigid follower moves urging the wall of the flexible liner opposite of the dispensing wall of the flexible liner to move therewith to the level of the bulk material stored in the flexible liner and to apply a uniform force to the bulk material during the removal thereof.

A modified flexible liner for a bulk material container comprising a dispensing Wall, a collapsible wall for containing bulk material stored in the flexible liner, a wall opposite to the dispensing wall, and a rigid follower attached to the wall opposite the dispensing wall thereof. During the removal of bulk material from the flexible liner, the rigid follower under the urgency of a differential pressure and/or gravity moves urging the wall opposite of the dispensing wall to move therewith to the level of the bulk material stored in the flexible liner and to apply a uniform force to the bulk material during the removal thereof.

A further modified bulk material container comprises a flexible liner disposed in a suitable shell. The flexible liner stores bulk material to be dispensed from the container. A rigid follower is attached to the flexible liner at the top wall thereof. During the removal of bulk material from a side wall of the flexible liner, the follower moves downwardly urging the top wall of the flexible liner to move downwardly therewith to the level of the upper surface of the bulk material stored in the flexible liner and to apply a uniform force to the bulk material during the removal thereof.

A further modified flexible liner for a bulk material container comprising a bottom wall, a collapsible dispensing wall for storing bulk material and formed with a side discharge opening, a top wall and a rigid follower attached at the top wall. During the removal of bulk material from the flexible liner from the side discharge opening of the collapsible wall, the follower moves downwardly under the urgency of differential pressure and/or gravity urging the top wall to move downwardly therewith to the level of the bulk material stored in the flexible liner and to apply a uniform force to the bulk material during the removal thereof.

An object of the present invention is to provide a bulk material container in which the loss of usable bulk material stored within the bulk material container is reduced; in which the inner wall of the shell of the bulk material container is maintained clean; in which the underside of the follower is maintained clean and in which the bottom wall of the container is maintained clean; and in which contamination of the inner wall of the shell of the bulk material container is eliminated, in which contamination of the underside of the follower is eliminated and in which contamination of the bottom wall of the container is eliminated.

Another object of the present invention is to provide a bulk material container in which a product stored in the container is protected against contamination by an improved flexible liner.

A feature of the present invention is the provision of a rigid base member affixed to the flexible liner at the bottom of the flexible liner for spreading out the bottom of the flexible liner during the installation of the flexible liner in the bulk material container.

Another feature of the present invention is that the follower does not contact directly the bulk material stored in the flexible liner and the inner wall of the shell of the bulk material container does not contact directly the bulk material within the bulk material container and the bottom wall of the shell does not contact directly the bulk material within the bulk material container. Thus, neither the follower nor the inner wall nor the bottom wall of the bulk material container will be contaminated by the bulk material within the bulk material container.

Another feature of the present invention is to provide a flexible liner for a bulk material container in which flexible liner bulk material is stored and the bulk material is removed from the flexible liner through the insertion of a pump into the flexible liner.

Another feature of the present invention is to provide a flexible liner for a bulk material container in which bulk material is stored and from which bulk material is dispensed from a bottom opening in the flexible liner without air entering the liner, the flexible liner folds as the bulk material is removed therefrom.

Another feature of the present invention is to provide a flexible liner for a bulk material container in which bulk material is discharged through the top of the lining for storage therein and in which bulk material is dispensed from the bottom of the flexible liner.

DESCRIPTION OF THE PREFERRED EMBODIMENT

Figure 1:
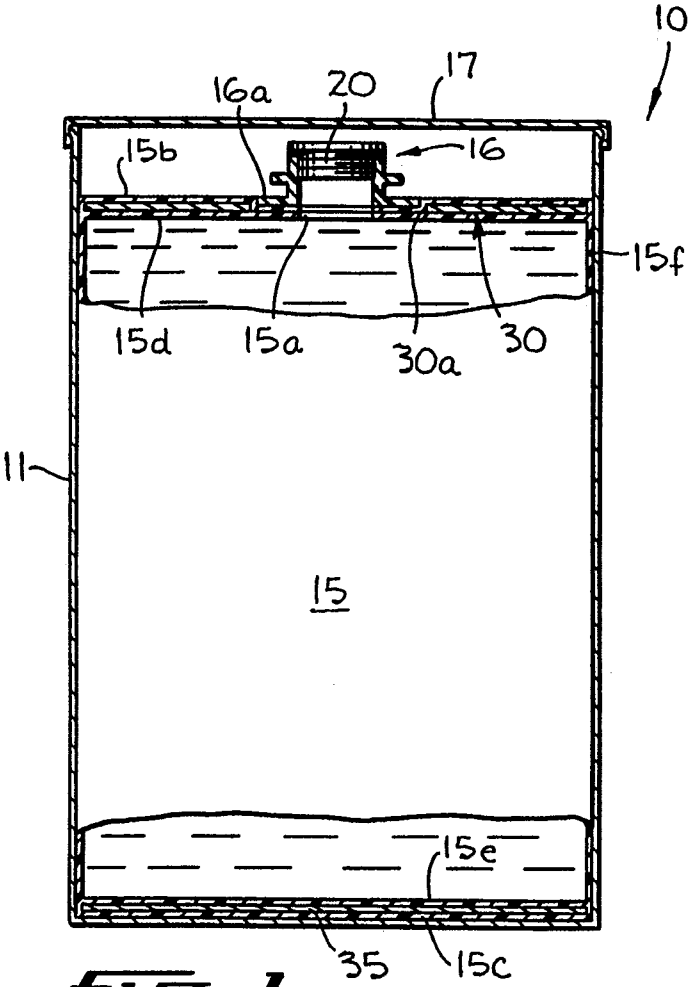
FIG. 1 is an axial sectional view of a bulk material container embodying the present invention with a shipping cover installed thereon for transporting the bulk material container. A flexible liner is disposed in the shell of the bulk material container for containing bulk material and a plug closes the bulk material dispensing opening at the top of the flexible liner.

Illustrated in FIG. 1 is a bulk material container 10 suitable for transporting bulk material, such as grease. Disposed within a suitable shell 11 of the bulk material container 10 is a flexible liner 15. The shell 11 is preferably rigid and is made of suitable material such as stainless steel or aluminum. The flexible liner 15 is made of suitable material, such as polyvinyl chloride or polyethylene.

At the top of the flexible liner 15 is a suitable dispensing opening 15*a*. Bulk material, such as grease, is stored in the flexible liner 15. A well-known relatively rigid threaded outlet fitting 16 is sealed to a top dispensing wall 15*b* of the flexible liner 15 and surrounds the discharge opening 15*a*. The outlet fitting 16 is made of suitable material, such as polyvinyl chloride, in a relatively rigid state. A perimetric flange 16*a* of the outlet fitting 16 is sealed to the top dispensing wall 15*b* of the flexible liner 15.

Polyvinyl chloride is a material that lends itself to heat sealing. The flange 16*a* of the outlet fitting 16, in the preferred embodiment, is heat sealed, bonded, or otherwise caused to adhere in a conventional manner to the top surface of the top dispensing wall 15*b* of the flexible liner 15.

During the transportion of the bulk material container 10 and the bulk material stored in the flexible liner 15, a conventional shipping cover 17 is removably secured to the top of the shell 11 in a well-known manner. A suitable plug 20 is in threaded engagement with the threads of the outlet fitting 16 to close the dispensing opening 15*a* of the flexible liner 15 in a fluid tight manner during the transporting of the bulk material container 10 and the bulk material stored in the flexible liner 15.

Figure 2:
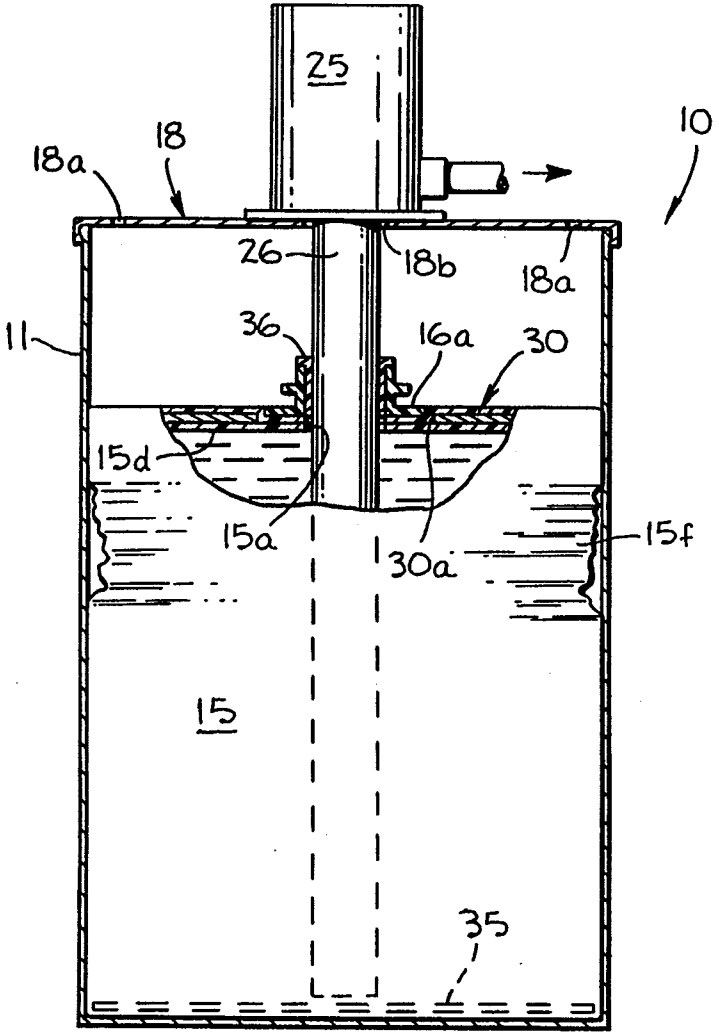
FIG. 2 is a diagrammatic sectional view of the bulk material container shown in FIG. 1 with the shipping cover and plug removed and with a pump installed for removing bulk material from the top dispensing opening of the flexible liner.

Illustrated in FIG. 2 is the bulk material container 10 in condition for dispensing bulk material from the flexible liner 15. Toward this end, the shipping cover 17 has been removed. A cover 18 is thereupon secured to the top of the shell 11 in a well-known manner. The cover 18 is formed with vents 18*a* and a dispensing opening 18*b*. Additionally, the plug 20 has been removed from the outlet fitting 16. A conventional and well-known suction pump 25 is installed on the pump support cover 18. A tubular pump shaft 26 extends from the pump 25, through the dispensing opening 18*b* of the cover 18, through the outlet fitting 16, through the dispensing opening 15*a* of the flexible liner 15 and into the flexible liner 15 spaced slightly above a bottom wall 15*c* of the flexible liner 15. A suitable bushing 36 is disposed in threaded engagement with the internal threads of the outlet fitting 16 and engages the wall of the tubular shaft 26 to provide a fluid tight seal. The vents 18*a* of the pump support cover 18 provide openings for air under atmospheric pressure to enter the shell 11.

Figure 4:
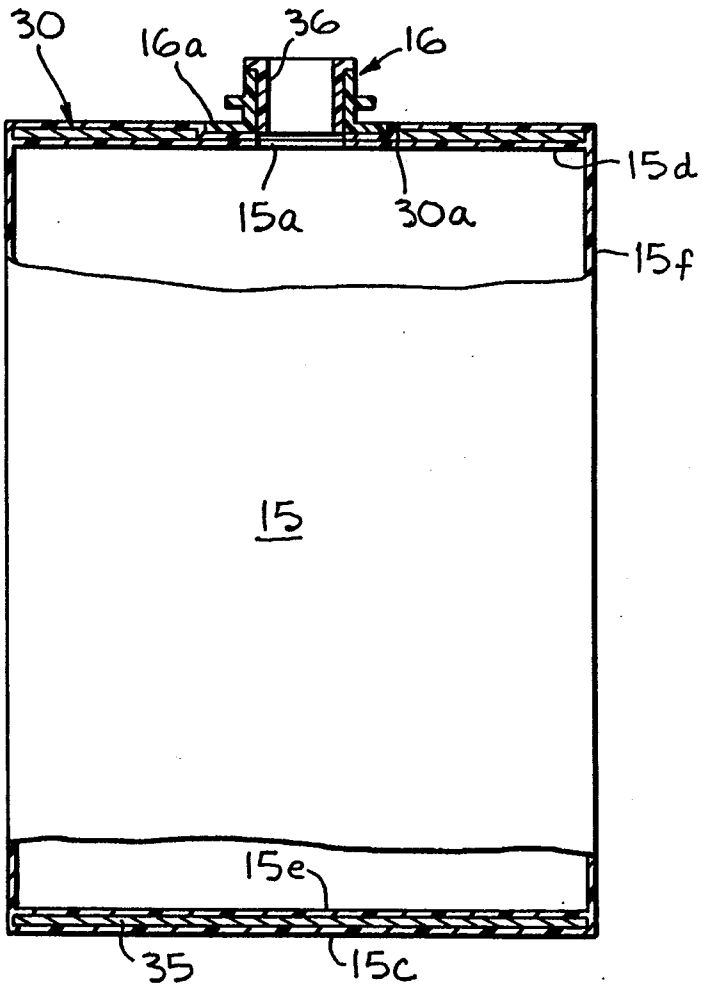
FIG. 4 is an axial sectional view, partly in elevation, of the flexible liner shown in FIGS. 1–3 with the plug removed from the top dispensing opening and particularly illustrating a rigid follower attached at the top wall of the flexible liner and a rigid base attached to the bottom wall of the flexible liner.
Figure 3:
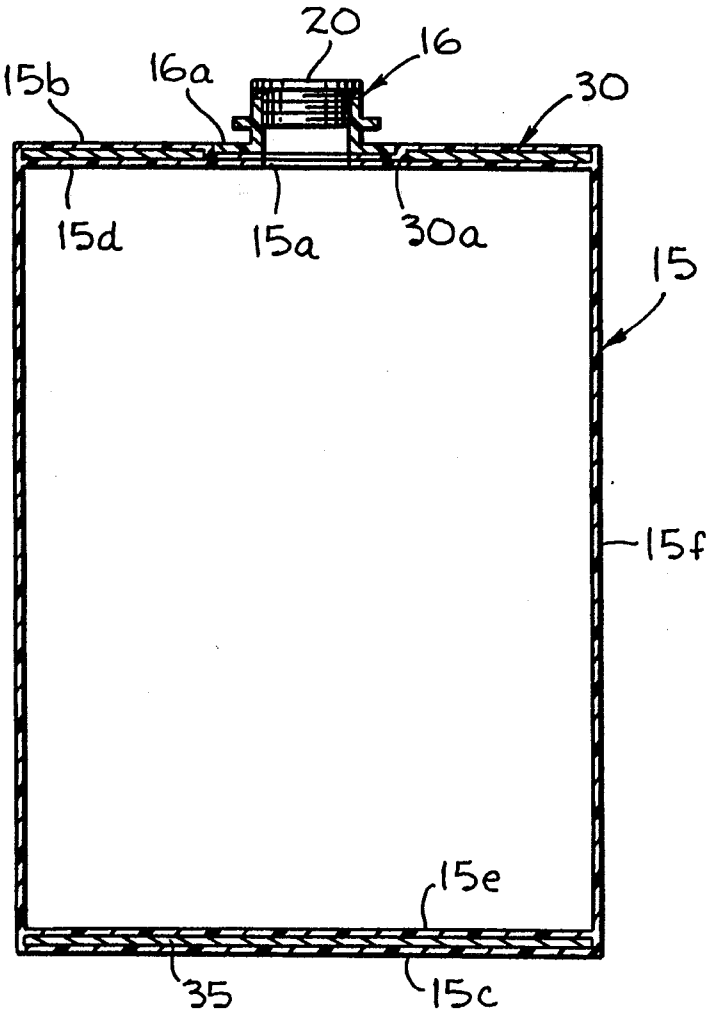
FIG. 3 is an axial sectional view of the flexible liner shown in FIGS. 1 and 2 illustrated with the plug installed in the top dispensing opening thereof.

The flexible liner 15 (FIGS. 3 and 4) comprises a rigid follower 30 made of suitable rigid material, such as metal, fiberboard or plywood. The diameter of the rigid follower 30 is slightly less than the diameter of the flexible liner 15 and includes, in the exemplary embodiment, a central opening 30*a* through which passes the tubular shaft 26 of the pump 25 (FIG. 2). The rigid follower 30 is fixed to the flexible liner 15 at the top dispensing wall 15*b* thereof. In the exemplary embodiment, the rigid follower 30 is secured to the flexible liner 15 below the top dispensing wall 15*b* . In the preferred embodiment, the rigid follower 30 is secured to the top dispensing wall 15*b* of the flexible liner 15 below the top wall 15*b* and within a fully enclosed pocket 15*d* so as not to expose the rigid follower 30 to the bulk material stored in the flexible liner 15.

As bulk material is removed from the flexible liner 15 by the pump 25, the flexible liner 15 (FIG. 2) deflates and an upstanding collapsible wall 15*f* thereof folds with the top dispensing wall 15*b* moving toward the bottom wall 15*c*. The top dispensing wall 15*b* and the bottom wall 15*c* form a fluid tight relationship with the upstanding collapsible wall 15*f*. The follower 30 urges the top dispensing wall 15*b* downwardly in the axial direction of the flexible liner 15. A differential pressure applied to the upper surface of the rigid follower 30 and the lower surface of the rigid follower 30, and/or the influence of gravity, as material is removed from the flexible liner 15, causes the rigid follower 30 to apply a uniform force to the bulk material in the flexible liner 15 to move the bulk material downwardly within the flexible liner 15. Through the application of air under atmospheric pressure passing through the vents 18*a* (FIG. 2) onto the follower 30, a differential pressure is created between the forces applied to the opposing surfaces of the rigid follower 30 during the removal of bulk material from the flexible liner 15. During the downward movement of the follower 30, the plane of the rigid follower 30 and the plane of the top dispensing wall 15*b* are maintained perpendicular to the axis of the flexible liner 15 by the inner wall of the shell 11 and the tube 26. The rigid follower 30 and the top dispensing wall 15*b* move continuously toward the upper surface of the bulk material stored in the flexible liner 15 and they continuously maintain a height substantially equal to the level of the bulk material in the flexible liner 15 as bulk material is removed from the flexible liner 15 by the pump 25. The rigid follower 30 applies a uniform force to the bulk material contained within the flexible liner 15.

In the preferred embodiment, the flexible liner 15 comprises a flat, rigid base 35 (FIGS. 3 and 4) made of suitable material, such as metal, fiberboard, or plywood. The diameter of the rigid base 35 is slightly less than the diameter of the flexible liner 15. The flat, rigid base 35 is fixed to the flexible liner 15 at the bottom wall 15*c* thereof. In the exemplary embodiment, the rigid base 35 is secured to the flexible liner 15 above the bottom wall 15*c*. In the preferred embodiment, the rigid base 35 is secured to the bottom wall 15*c* of the flexible liner 15 above the bottom wall 15*c* and within a fully enclosed pocket 15*e* so as not to expose the rigid base 35 to the bulk material stored in the flexible liner 15.

The flat, rigid base 35 serves to maintain the bottom wall 15*c* in a fully extended condition during the installation of the flexible liner 15 in the shell 11. The rigid base 35 facilitates the installation of the flexible liner 15 in the shell 11 and tends to reduce folds in the flexible liner 15 that may trap bulk material.

Figure 6:
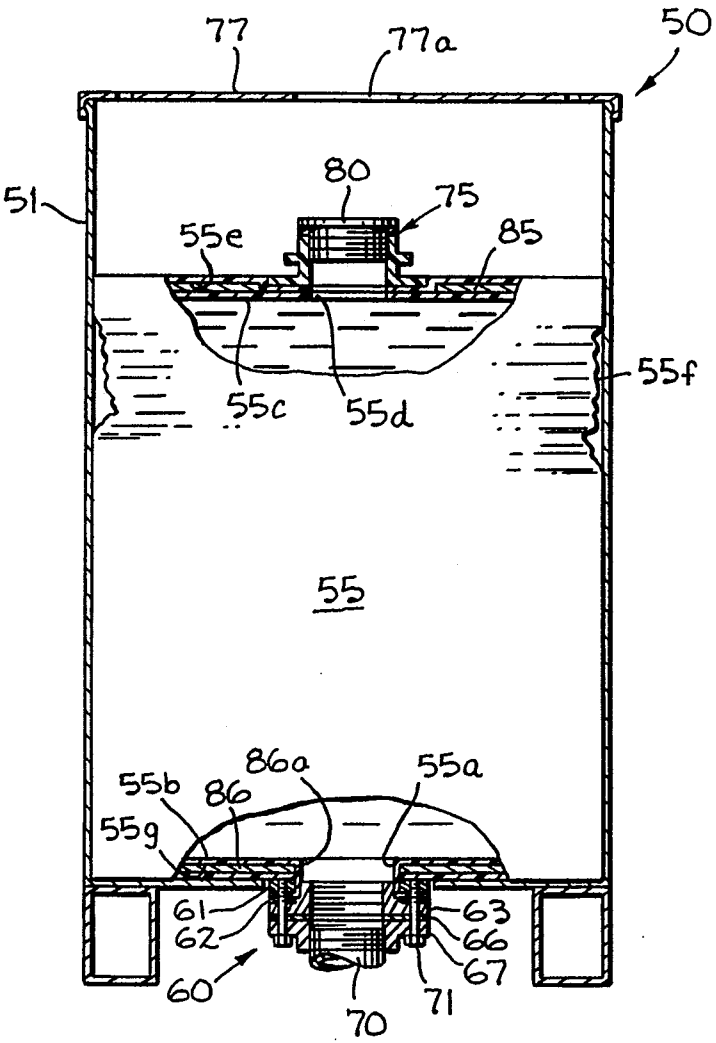
FIG. 6 is a diagrammatic sectional view of the bulk material container shown in FIG. 5 with the plug removed from the bottom dispensing opening for the removal of bulk material from the bottom dispensing opening.
Figure 5:
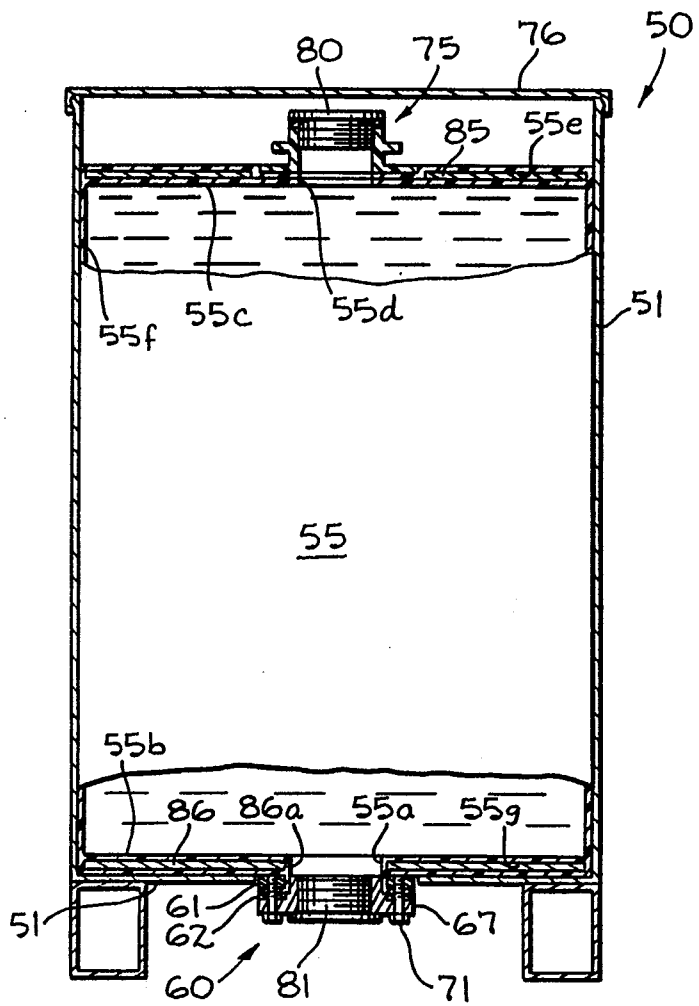
FIG. 5 is an axial sectional view of a modified bulk material container embodying the present invention with a shipping cover installed thereon for transporting the bulk material container. A flexible liner is disposed in the shell of the bulk material container for containing bulk material. The flexible liner has bottom and top dispensing openings with plugs installed therein for closing the bottom and top dispensing openings.

Illustrated in FIGS. 5 and 6 is a modified bulk material container 50 suitable for dispensing bulk material such as grease. Disposed within a suitable shell 51 of the bulk material container 50 is a flexible liner 55. The shell 51 is preferably rigid and is made of suitable material, such as stainless steel or aluminum. The flexible liner 55 is made of suitable material, such as polyvinyl chloride or polyethylene.

At the bottom of the flexible liner 55 is a suitable dispensing opening 55*a*. Bulk material, such as grease, is stored in the flexible liner 55. A suitable bottom outlet fitting 60 is clamped or sealed to a bottom dispensing wall 55*b* of the flexible liner 55 and surrounds the bottom dispensing opening 55*a*.

During the removal of bulk material from the flexible liner 55 through the bottom dispensing opening 55*a* (FIG. 6), the bottom outlet fitting 60 comprises an annular disc 61 to which the bottom dispensing wall 55*b* is sealed. The section of the bottom dispensing wall 55*b*, surrounding the dispensing opening 55*a*, is folded about the central opening of the disc 61 and is sealed thereto in a suitable manner. In the exemplary embodiment, the disc 61 is made of suitable material, such as polyvinyl chloride in a relatively rigid state. Abutting against the disc 61 is a suitable gasket 62. An internally threaded flange 63 projects into the gasket 62 and the disc 61 and engages the gasket 62 in abutting relation. In the exemplary embodiment, the internally threaded flange 63 is made of polyvinyl chloride in a relatively rigid state.

Abutting against the internally threaded flange 63 is a suitable gasket 66. An internally threaded flange 67 abuts against the gasket 66. The internally threaded flange 67, in the exemplary embodiment, is made of polyvinyl chloride in a relatively rigid state. An external pipe 70 is disposed in threaded engagement with the internally threaded flange 67. The bottom outlet fitting 60 provides a fluid tight engagement with the external pipe 70. Bolts 71 secure the flange 67, the gasket 66, the flange 63, the gasket 62 and the disc 61 together to provide a bottom outlet discharge passage for bulk material to be removed from the flexible liner 55. It is within the contemplation of the present invention that bulk material may be deposited into the liner 55 via the bottom outlet fitting 60.

Figure 8:
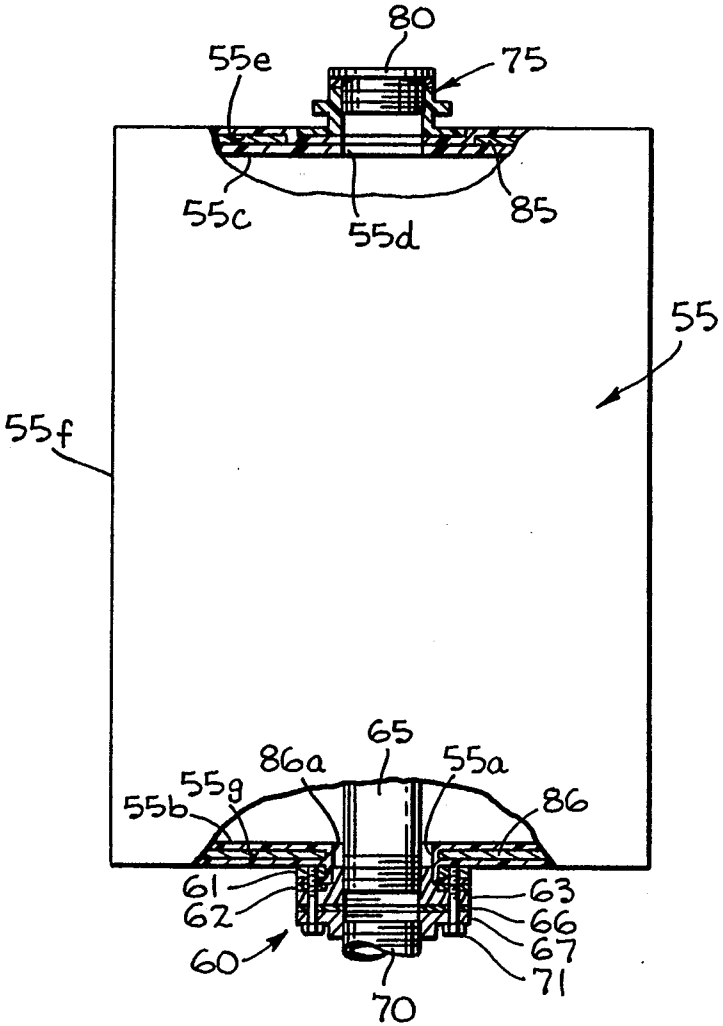
FIG. 8 is an elevational view, partly in section, of the flexible liner shown in FIGS. 5–7 with the plug installed in the bottom dispensing opening removed and with an internal pipe for sparging installed and particularly illustrating a rigid follower attached at the top wall of the flexible liner and a rigid base attached to the bottom wall of the flexible liner.

An internal pipe 65 (FIGS. 8) may optionally be installed in the dispensing opening 55*a* of the flexible liner 55 in threaded engagement with the internally threaded flange 63. The internal pipe 65 is employed when an internal sparger of a distributing device is required as a filter when dispensed product is a contaminant. The bottom outlet fitting 60 provides a fluid tight engagement with the pipe 65 when installed.

The flexible liner 55 comprises a top wall 55*c*. Formed in the top wall 55*c* is an opening 55*d*. A suitable rigid threaded outlet fitting 75 includes a perimetric flange that is sealed to the top wall 55*c* of the flexible liner 55 and surrounds the opening 55*d*. The outlet fitting 75 is made of suitable material, such as polyvinyl chloride in a relatively rigid state. The fitting 75, in the preferred embodiment, is heat sealed, bonded or otherwise caused to adhere in a conventional manner to the top wall 55*c* through its perimetric flange.

During the transportation of the bulk material container 50 (FIG. 5) and the bulk material stored in the flexible liner 55, a conventional shipping cover 76 is removably secured to the top of the shell 51 in a well-known manner. A suitable plug 80 is in threaded engagement with the threads of the fitting 75 to close the opening 55*d* of the flexible liner 55 and a suitable plug 81 is in threaded engagement with the threads of the internally threaded flange 63 at the bottom wall 55*b* of the flexible liner 55 during the transportation of the bulk material container 50 and the bulk material stored in the flexible liner 55. It is within the contemplation of the present invention that suitable valves may be used in lieu of plugs.

During the transportation of the bulk material container 50 and the bulk material stored in the flexible liner 55, the pipe 65 when installed, the gasket 66, the internally threaded flange 63 and the pipe 70 are removed from the outlet fitting 60. The disc 61, the gasket 62 and the flange 67 remain and are secured together by the bolts 71 during the transportation of the bulk material container 50 and the bulk material stored in the flexible liner 55. Thus, the plug 80 is in fluid tight relation with the fitting 75 and the plug 81 is in fluid tight relation with the internally threaded flange 67 of the fitting 60 during the transportation of the bulk material container 50 and the bulk material stored in the flexible liner 55.

Illustrated in FIG. 6 is the bulk material container 50 in condition for dispensing bulk material through the dispensing opening 55*a* formed in the bottom dispensing wall 55*b* of the flexible liner 55. At this time, the shipping cover 76 has been removed. The plug 81 is removed from threaded engagement with the internally threaded flange 67 of the outlet fitting 60. Internally threaded flange 63 of the fitting 60 provides internal attachment for the internal pipe 65 for sparging should it be desired to have a pipe for sparging. The bolts 71 are removed from threaded engagement with the disc 61 and the internally threaded flange 63 is disposed in abutting relation with the gaskets 62 and 66, and the internally threaded flange 67 is now placed in abutting relation with the gasket 66. Thereupon, the bolts 71 secure the internally threaded flange 67, gasket 66, internally threaded flange 63, gasket 62 and the disc 61 together in fluid tight relation. Thereupon, a conventional cover 77 is installed that extends across the top of the shell 51. The cover 77 is formed with an opening 77*a* that is aligned with the opening 55*d* of the flexible liner 55. The outlet discharge pipe 70 is disposed in threaded engagement with the internally threaded flange 67.

At this time, air under atmospheric pressure enters the shell 51 through the opening 77*a* of the cover 77. It is apparent that the cover 77 can be removed for air under atmospheric pressure to enter the shell 51. During the removal of bulk material through the bottom outlet fitting 60, the plug 80 remains in threaded engagement with the fixture 75 of the flexible liner 55.

Should a metal closure be required during the transportation of the bulk material container 50 and the bulk material stored in the flexible liner 55, the pipe 70 is removed and the flange 67 is replaced by a metal blind flange. The plug 81 is also replaced by the metal blind flange. When the bulk material container is in condition for dispensing bulk material through the opening 55*a* formed in the bottom dispensing wall 55*b*, the blind flange is removed from engagement with the internally threaded flange 67 of the outlet fitting 60.

The flexible liner 55 (FIGS. 7 and 8) comprises a rigid follower 85 made of suitable rigid material, such as metal, fiberboard or plywood. The diameter of the rigid follower 85 is slightly less than the diameter of the flexible liner 55. The rigid follower 85 is fixed to the flexible liner 55 at the top wall 55*c* thereof. In the exemplary embodiment, the rigid follower 85 is secured to the flexible liner 55 below the top wall 55*c*. In the preferred embodiment, the rigid follower 85 is secured to the top wall 55*c* and within a fully enclosed pocket 55*e* so as not to expose the rigid follower 85 to the bulk material stored in the flexible liner 55.

As bulk material is removed from the flexible liner 55, the flexible liner 55 deflates and an upstanding collapsible wall 55*f* thereof folds with the top wall 55*c* moving toward the bottom dispensing wall 55*b*. The top wall 55*c* and the bottom wall 55*b* form a fluid tight relationship with the upstanding collapsible wall 55*f*. Through the application of air under atmospheric pressure or suitable positive pressure passing through the opening 77*a* (FIG. 6) onto the follower 85, a differential pressure is applied to the opposing surfaces of the rigid follower 85 during the removal of bulk material from the flexible liner 85 causing the follower 85 to move downwardly to the level of bulk material in the flexible liner 85 and apply a uniform force thereto. Gravity alone or in conjunction with a differential pressure may be externally applied to the rigid follower 85 to move the rigid follower 85 downwardly for the application of a uniform force on the bulk material stored in the flexible liner 55.

During the downward movement of the follower 85, the plane of the rigid follower 85 and the plane of the top wall 55*c* are maintained perpendicular to the axis of the flexible liner 55 by the inner wall of the shell 51. The rigid follower 85 and the top wall 55*c*move continuously toward the upper surface of the bulk material stored in the flexible liner 55 and they continuously maintain a height substantially equal to the level of the bulk material in the flexible liner 55 as bulk material is removed from the flexible liner 55 through the dispensing opening 55*a* in the bottom dispensing wall 55*b*. The rigid follower 85 applies a uniform force to the bulk material contained within the flexible liner 85.

In the preferred embodiment, the flexible liner 55 comprises a flat, rigid base 86 made of suitable material, such as metal, fiberboard or plywood. The diameter of the rigid base 86 is slightly less than the diameter of the flexible liner 55. The flat, rigid base 86 is fixed to the flexible liner 55 at the bottom dispensing wall 55*b*. A suitable opening 86*a* is formed in the rigid base 86 and it is aligned with the discharge opening 55*a* of the bottom dispensing wall 55*b* to enable bulk material to be removed from the flexible liner 55.

In the exemplary embodiment, the rigid base 86 is secured to the bottom wall 55*b* thereabove. In the preferred embodiment, the rigid base 86 is secured to the bottom wall 55*b* thereabove and within a fully enclosed pocket 55*g* so as not to expose the rigid base 86 to the bulk material stored in the flexible liner 55.

The flat, rigid base 86 serves to maintain the bottom dispensing wall 55*b* in a fully extended position during the installation of the flexible liner 55 in the shell 51. The rigid base 86 facilitates the installation of the flexible liner 55 in the shell 51 and tends to reduce folds in the flexible liner 55 that may trap bulk material.

Figure 7:
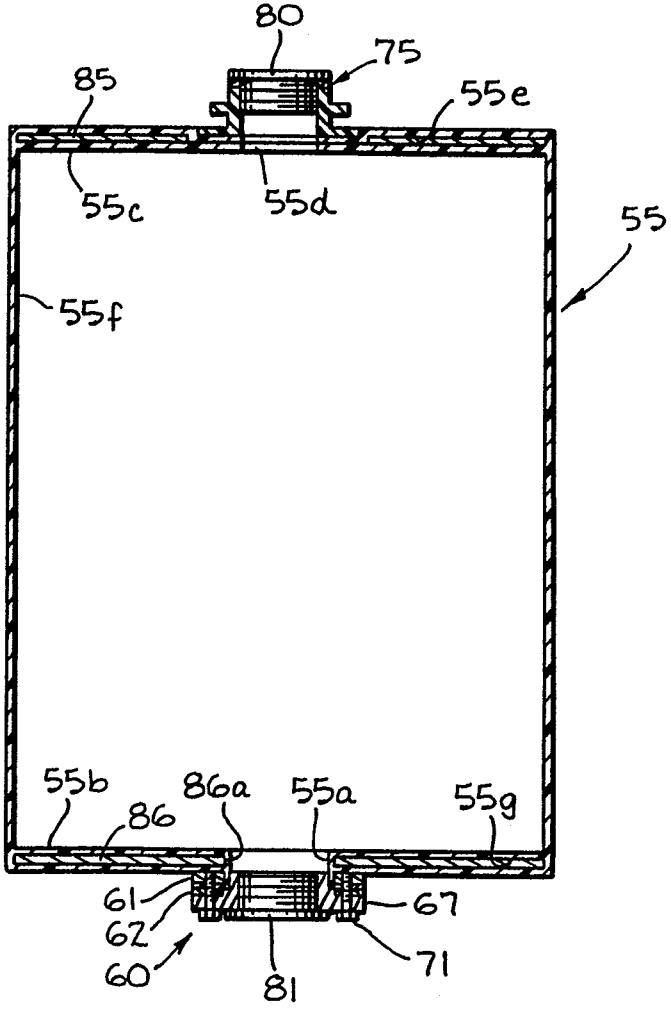
FIG. 7 is an axial sectional view of the flexible liner shown in FIGS. 5 and 6 illustrated with plugs respectively installed in the bottom and top dispensing openings.

Alternatively, bulk material may be removed through the dispensing opening 55*d* of the top wall 55*c* by using the pump 25 and the tubular pump shaft 26 heretofore described in connection with FIG. 2. The operation is similar to that heretofore described in connection with FIG. 2. In order to remove bulk material through the dispensing opening 55*d*, the plug 81 is reinserted into the bottom outlet fitting 60 in the manner heretofore described for threaded engagement with the internally threaded flange 67 (FIG. 7). The plug 80 is removed from the fitting 75. Now, the pump 25 and the tubular pump shaft 26 are installed in the manner heretofore described in connection with FIG. 2. The operation is similar to that heretofore described in connection with FIG. 2.

In the top filling of the flexible liner 55 with bulk material, the bottom plug 81 is disposed in threaded engagement with the bottom outlet fitting 60 in the manner heretofore described and the plug 80 is removed from the fitting 75. Bulk material is then discharged through the opening 55*d* into the flexible liner 55 in a conventional and well-known manner.

For the bottom filling of the flexible liner 55 with bulk material, the top plug 80 is disposed in threaded engagement with the fitting 75 in the manner heretofore described and the plug 81 is removed from the fitting 60. The pipe 70 is installed in the manner heretofore described. Bulk material enters the flexible liner through the pipe 70 and the fitting 60. Prior to the feeding of bulk material into the liner 55, the flexible liner 55 is collapsed or extended through the temporary removal of the plug 80 from the fitting 75.

In the event a metallic closure is required for the transport of bulk material, the plug 81 is replaced by a metallic blind flange or plug.

Figure 10:
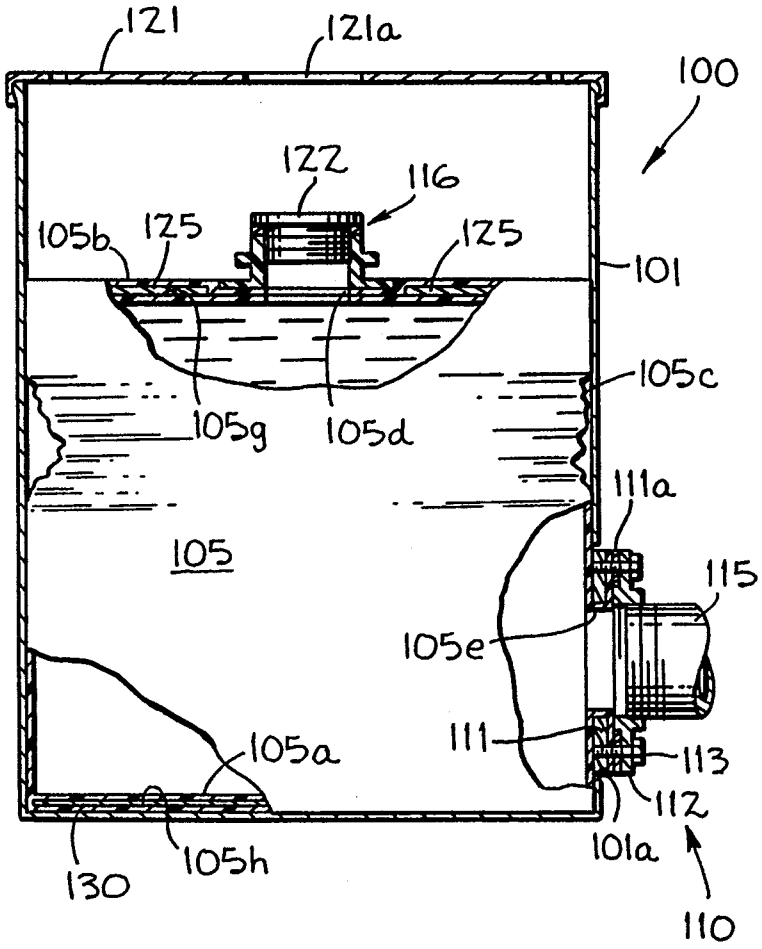
FIG. 10 is a diagrammatic sectional view of the bulk material container shown in FIG. 9 with the plug removed from the side dispensing opening for the removal of bulk material from the side dispensing opening.
Figure 9:
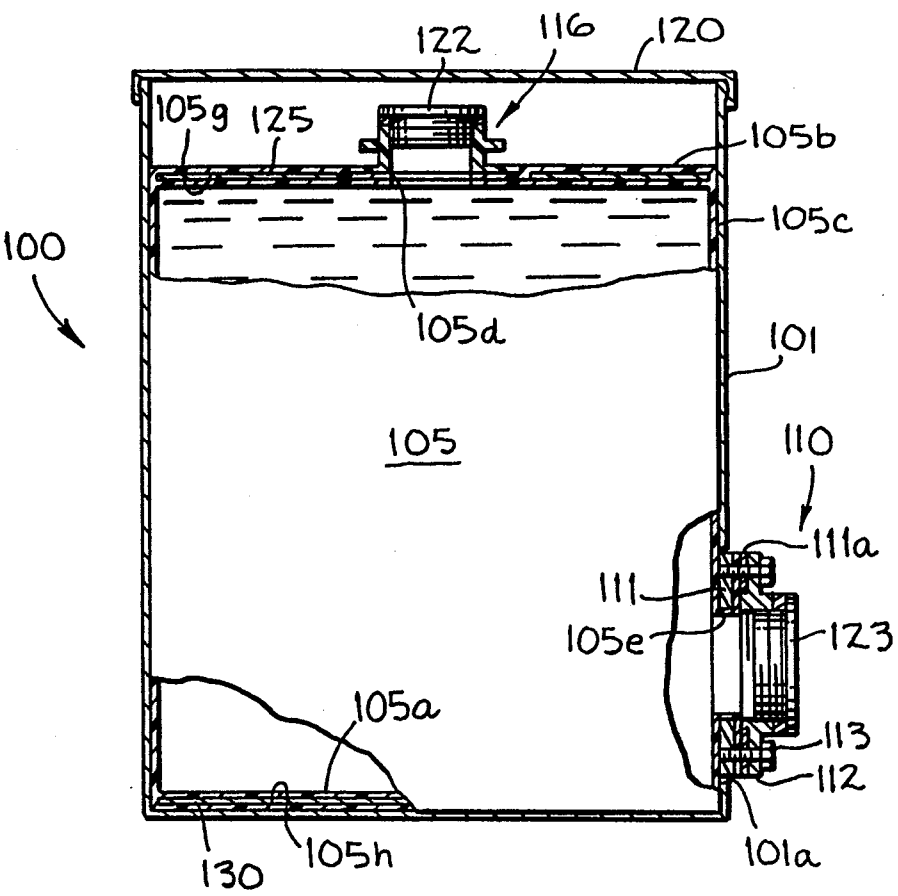
FIG. 9 is an axial sectional view of a further modification of the bulk material container embodying the present invention with a shipping cover installed thereon for transporting the bulk material container. A flexible liner is disposed in the shell of the bulk material container for containing bulk material. The flexible liner has a side dispensing opening and a top dispensing opening with plugs respectively installed therein for closing the side dispensing opening and the top dispensing opening.

Illustrated in FIGS. 9 and 10 is a further modified bulk material container 100 suitable for dispensing flowable bulk material, such as grease, oils, paint, ink, treated water and other liquid chemicals. Disposed within a suitable shell 101 of the bulk material container 100 is a flexible liner 105. The shell 101 is preferably rigid and is made of suitable material, such as mild steel, stainless steel or aluminum. The flexible liner 105 is made of suitable material, such as polyvinyl chloride or polyethylene.

Figure 12:
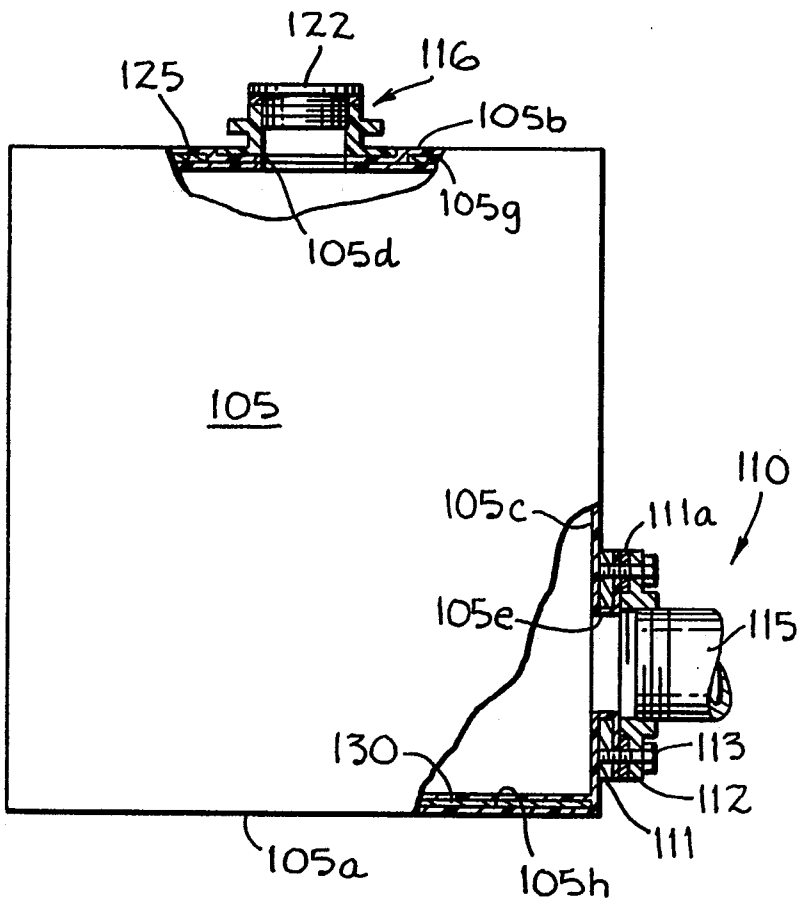
FIG. 12 is an elevational view, partly in section, of the flexible liner shown in FIG. 11 with the plug in the side dispensing opening removed and particularly illustrating a rigid follower attached at the top wall of the flexible liner and a rigid base attached to the bottom wall of the flexible liner.
Figure 11:
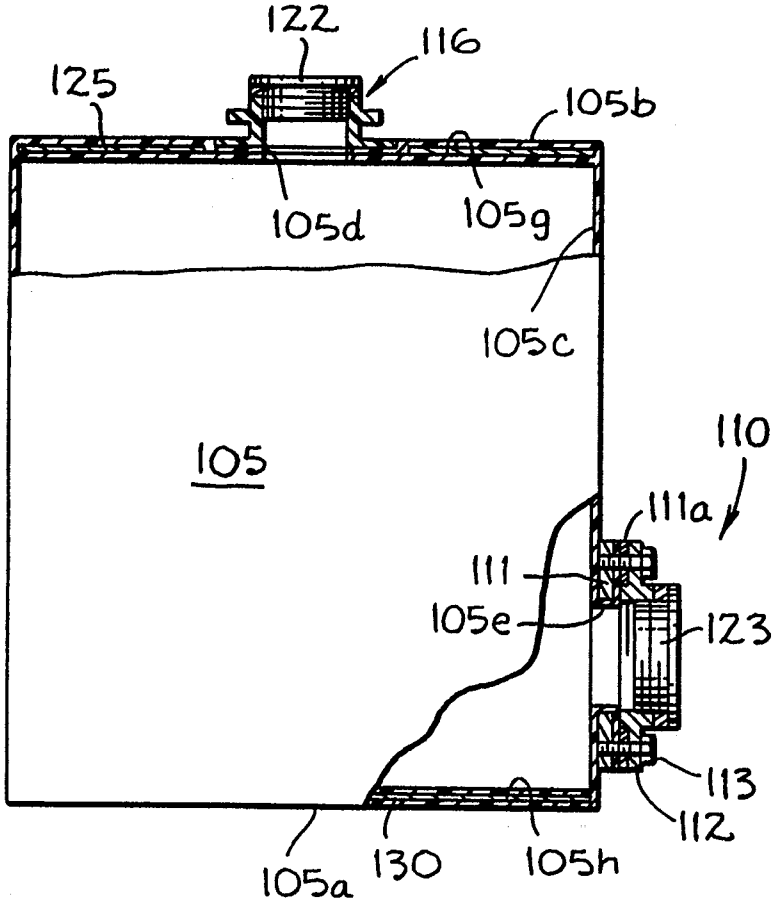
FIG. 11 is an elevational view, partly in section, of the flexible liner shown in FIGS. 9 and 10 illustrated with plugs respectively installed in the side dispensing opening thereof and in the top dispensing opening thereof.

The flexible liner 105 (FIGS. 11 and 12) comprises a bottom wall 105*a*, a top wall 105*b* and an upstanding collapsible dispensing wall 105*c*. Formed in the top wall 105*b* is a suitable opening 105*d* and formed in the collapsible dispensing wall 105*c* is a dispensing opening 105*e*. A suitable side outlet fitting 110 is sealed to the upstanding collapsible dispensing wall 105*c* of the flexible liner and surrounds the side dispensing opening 105*e*. An opening 101*a* in the upstanding wall of the shell 101 is aligned with the dispensing opening 105*e* of the flexible liner 105 for the passage of bulk material therethrough.

In the exemplary embodiment, the side outlet fitting 110 comprises an annular disc ill to which the collapsible dispensing wall 105*c* is sealed. The disc 111 is sealed to the collapsible dispensing wall 105*c*, in the exemplary embodiment, by heat sealing, bonding or otherwise caused to adhere in a conventional manner. In the exemplary embodiment, the disc 111 is made of suitable material, such as polyvinyl chloride in a relatively rigid state, and is heat sealed to the wall of the flexible liner 105 surrounding the discharge opening 105*e*. Abutting against the disc 111 is an internally threaded flange 112. A gasket 111*a* is disposed between the disc 111 and the flange 112. The internally threaded flange 112 is secured to the disc 111 by means of bolts 113. For removing bulk material from the flexible liner 105, a dispensing pipe 115 (FIGS. 10 and 12) is disposed in threaded engagement with the internally threaded flange 112. In the exemplary embodiment, the internally threaded flange 112 and the dispensing pipe 115 are made of polyvinyl chloride in a relatively rigid state.

A suitable rigid threaded outlet fitting 116 includes a perimetric flange that is sealed to the top wall 105*b* of the flexible liner 105 and surrounds the opening 105*d* formed in the top wall 105*b* . The outlet fitting 116 is made of suitable material, such as polyvinyl chloride in a relatively rigid state. The outlet fitting 116, in the preferred embodiment, is heat sealed, bonded or otherwise caused to adhere in a conventional manner to the top wall 105*b* through its perimetric flange.

During the transporting of the bulk material container 100 (FIG. 9) and the bulk material stored in the flexible liner 105, a conventional shipping cover 120 is removably secured to the top of the shell 101 in a well-known manner. A suitable plug 122 is in threaded engagement with the threads of the fitting 116 to close the opening 105*d* of the flexible liner 105 and a suitable side plug 123 is in threaded engagement with the internally threaded flange 112 during the transportation of the bulk material container 100 and the bulk material stored in the flexible liner 105. Thus, the plug 122 is in fluid tight engagement with the fitting 116 and the plug 123 is in fluid tight engagement with the internally threaded flange 112 during the transportation of the bulk material container 100 and the bulk material stored in the flexible liner 105. It is apparent that suitable valves may be employed in lieu of plugs.

The flexible liner 105 (FIGS. 11 and 12) comprises a rigid follower 125 made of suitable rigid material, such as metal, fiberboard or plywood. The diameter of the rigid follower 125 is slightly less than the diameter of the flexible liner 105. The rigid follower 125 is fixed to the flexible liner 105 at the top wall 105*b* thereof. In the exemplary embodiment, the rigid follower 125 is secured to the flexible liner 105 below the top wall 105*b* . In the preferred embodiment, the rigid follower 125 is secured to the top wall 105*b* and within a fully enclosed pocket 105*g* so as not to expose the rigid follower 125 to the bulk material stored in the flexible liner 105.

Illustrated in FIG. 10 is the bulk material container 100 in condition for dispensing bulk material through the side dispensing opening 105*e* formed in the collapsible dispensing wall 105*c* . At this time, the shipping cover 120 has been removed. The plug 123 is removed from threaded engagement with the internally threaded flange 112 of the fitting 110. The internally threaded flange 112 is now placed in abutting relation with the gasket 111*a*. Thereupon, the bolts 113 secure the internally threaded flange 112, gasket 111*a*, and the disc 111 together in fluid tight relation.

At this time, air under atmospheric pressure enters the shell 101 through the opening 121*a* of the cover 121. In the alternative, the cover 121 can be removed and air under atmospheric pressure enters the shell 101. Should it be desired, the cover 121 is installed in the manner above-described and a pump, not shown, can be installed on the cover 121 and air under pressure is applied through the vent opening 121*a*. During the removal of bulk material through the side outlet fitting 110, the plug 122 remains in threaded engagement with the fitting 116 of the flexible liner 105.

As bulk material is removed from the flexible liner 105, the flexible liner 105 deflates and the upstanding collapsible dispensing wall 105*c* thereof folds with the top wall 105*b* moving toward the bottom wall 105*a*. The top wall 105*b* and the bottom wall 105*a* form a fluid tight relationship with the collapsible dispensing wall 105*c* . Through the application of air under atmospheric pressure or compressed air passing through the opening 121*a* (FIG. 10) onto the rigid follower 125, a differential pressure is applied to the opposing surfaces of the rigid follower 125 during the removal of bulk material from the flexible liner 105 causing the rigid follower 125 to move downwardly to the level of the bulk material in the flexible liner 105 and apply a uniform force thereto. Gravity alone or in conjunction with a differential pressure may be applied to the rigid follower 125 to move the rigid follower 125 downwardly for the application of force on the bulk material stored in the flexible liner 105 during the removal of bulk material from the flexible liner 105.

During the downward movement of the rigid follower 125, the plane of the rigid follower 125 and the plane of the top wall 105*b* are maintained perpendicular to the axis of the flexible liner 105 by the inner wall of the shell 101. The rigid follower 125 and the top wall 105*b* move continuously toward the upper surface of the bulk material stored in the flexible liner 105 and they continuously maintain a height substantially equal to the level of the bulk material in the flexible liner 105 as bulk material is removed from the flexible liner 105 through the side discharge opening 105*e* in the collapsible dispensing wall 105*c* . The rigid follower 125 applies a uniform force to the bulk material contained within the flexible liner 105 until the follower 125 is at even height with the uppermost point of the side dispensing opening 105*e*.

In the preferred embodiment, the flexible liner 105 comprises a flat rigid base 130 made of suitable material, such as metal, fiberboard or plywood. The diameter of the rigid base 130 is slightly less than the diameter of the flexible liner 105. The flat rigid base 130 is fixed to the flexible liner 105 at the bottom wall 105*a*. In the exemplary embodiment, the rigid base 130 is secured to the bottom wall 105*a* thereabove. In the preferred embodiment, the rigid base 130 is secured to the bottom wall 105*a* thereabove and within a fully enclosed pocket 105*h* so as not to expose the rigid base 130 to the bulk material stored in the flexible liner 105.

The flat, rigid base 130 serves to maintain the bottom wall 105*a* in a fully extended position during the installation of the flexible liner 105 in the shell 101. The rigid base 130 facilitates the installation of the flexible liner 105 in the shell 101.

Alternatively, bulk material may be removed through the dispensing opening 105*d* of the top wall 105*b* by using the pump 25 and the tubular pump shaft 26 heretofore described in connection with FIG. 2. The operation is similar to the operation heretofore described in connection with FIG. 2. In order to remove bulk material through the dispensing opening 105*d*, the plug 123 (FIGS. 9 and 11) is reinserted into the side outlet fitting 110 in a manner heretofore described for threaded engagement with the internally threaded flange 112. The plug 122 is removed from the fixture 116. Now, the pump 25 and the tubular pump shaft 26 are installed in the manner heretofore described in connection with FIG. 2. The operation of the pump 25 and the tubular pump shaft 26 is similar to the operation heretofore described in connection with FIG. 2.

In the filling of the flexible liner 105 with bulk material, the side plug 123 is disposed in threaded engagement with the side outlet fitting 110 in the manner heretofore described (FIGS. 9 and 11) and the plug 122 is removed from the fitting 116 for bulk material to flow through the opening 105*d* into the flexible liner 105 in a conventional and well-known manner.

What is claimed is:

1. A flexible liner for a bulk material container adapted to store bulk material comprising:

(a) a dispensing wall;

(b) a collapsible wall forming a fluid tight relationship with said dispensing wall for enclosing bulk material stored in said flexible liner;

(c) a wall opposite to said dispensing wall forming a fluid tight relationship with said collapsible wall; and (d) a rigid follower attached to said dispensing wall for moving said dispensing wall to the level of bulk material stored in said flexible liner during the removal of bulk material from said flexible liner for applying a uniform force to said bulk material stored in said flexible liner.

2. A flexible liner as claimed in claim 1 wherein said dispensing wall and said rigid follower are formed with aligned discharge openings.

3. A flexible liner as claimed in claim 1 wherein said rigid follower is fixed to said dispensing wall within said collapsible wall.

4. A flexible liner as claimed in claim 1 wherein the perimeter of said rigid follower is substantially coextensive with the perimeter of said collapsible wall.

5. A bulk material container comprising:

A. a shell;

B. a cover for said shell; and

C. a flexible liner disposed in said shell for storing bulk material, said flexible liner comprising:

(a) a dispensing wall, (b) a collapsible wall forming a fluid tight relationship with said dispensing wall for enclosing bulk material stored in said flexible liner, the perimeter of said collapsible wall being slightly less than the perimeter of the inner wall of said shell, and (c) a wall opposite said dispensing wall forming a fluid tight relationship with said collapsible wall; and D. a rigid follower contiguous with and attached to said dispensing wall for moving said dispensing wall to the level of bulk material stored in said flexible liner under the urgency of gravity for applying a uniform force to the bulk material stored in said flexible liner during the removal of bulk material from said flexible liner.

6. A bulk material container as claimed in claim 5 wherein said dispensing wall, said rigid follower and said cover are formed with aligned discharge openings.

7. A bulk material container as claimed in claim 5 wherein said cover is formed with vent means for air under atmospheric pressure to enter said shell and wherein said rigid follower moves said dispensing wall to the level of bulk material stored in said flexible liner under the urgency of air under atmospheric pressure entering said shell through said vent means creating a differential pressure during the removal of bulk material from said flexible liner.

8. A flexible liner for a bulk material container adapted to store bulk material comprising:

(a) a dispensing wall with a discharge opening;

(b) a collapsible wall forming a fluid tight relationship with said dispensing wall for enclosing bulk material stored in said flexible liner;

(c) a wall opposite from said dispensing wall forming a fluid tight relationship with said collapsible wall; and (d) a rigid follower contiguous with and attached to said wall opposite said dispensing wall for moving said wall opposite said dispensing wall to the level of bulk material stored in said flexible liner during the removal of bulk material from said flexible liner for applying a uniform force to the bulk material stored in said flexible liner.

9. A flexible liner as claimed in claim 8 wherein said rigid follower is fixed at said wall opposite said dispensing wall within an enclosure defined by said collapsible wall.

10. A flexible liner as claimed in claim 8 wherein the perimeter of said rigid follower is substantially coextensive with the perimeter of said collapsible wall.

11. A bulk material container comprising:

A. a shell;

B. a cover for said shell; and

C. a flexible liner disposed in said shell for storing bulk material, said flexible liner comprising:

(a) a dispensing wall with a discharge opening, (b) a collapsible wall forming a fluid tight relationship with said dispensing wall for enclosing bulk material stored in said flexible liner, and (c) a wall opposite said dispensing wall forming a fluid tight relationship with said collapsible wall; and D. a rigid follower contiguous with and attached to said wall opposite said dispensing wall for moving said wall opposite to said dispensing wall to the level of bulk material stored in said flexible liner under the urgency of differential fluid pressure for applying a uniform force to the bulk material stored in said flexible liner during the removal of bulk material from said flexible liner.

12. A bulk material container as claimed in claim 11 wherein said cover is formed with vent means for air under atmospheric pressure to enter said shell and wherein said rigid follower moves said wall opposite said dispensing wall to the level of bulk material stored in said flexible liner under the urgency of air under atmospheric pressure entering said shell through said vent means creating a differential pressure during the removal of bulk material from said flexible liner.

* * * * *